US005380972A

United States Patent [19]

Lunak et al.

[11] Patent Number: 5,380,972

[45] Date of Patent: Jan. 10, 1995

[54] ROCKER SWITCH

[75] Inventors: Donald A. Lunak, Hanover Park; Declan E. Killarney, Chicago, both of Ill.

[73] Assignee: Motorola, Inc., Schaumburg, Ill.

[21] Appl. No.: 154,412

[22] Filed: Nov. 19, 1993

[51] Int. Cl.[6] ..... H01H 15/02

[52] U.S. Cl. ..... 200/562; 200/339; 200/408; 200/430

[58] Field of Search ..... 200/339, 430, 452, 553, 200/562, 563, 16 D, 408, 447

[56] References Cited

U.S. PATENT DOCUMENTS

| | | | |
|---|---|---|---|
| 1,668,974 | 5/1928 | Mottlau | 200/408 |
| 1,694,569 | 12/1928 | Walsh | 200/408 |
| 2,734,959 | 2/1956 | Immel . | |
| 3,155,806 | 11/1964 | Klingneberg . | |
| 3,479,478 | 11/1969 | Robbins | 200/557 |
| 3,519,775 | 7/1970 | Weremey . | |
| 3,525,960 | 8/1970 | Robbins | 200/562 X |
| 3,535,478 | 10/1970 | Lewis . | |
| 3,536,872 | 10/1970 | Gilardenghi . | |
| 3,591,747 | 7/1971 | Dennison . | |
| 3,671,693 | 6/1972 | Farrell . | |
| 3,691,325 | 9/1972 | Bogner . | |
| 3,770,920 | 11/1973 | Poliak . | |
| 3,922,510 | 11/1975 | Arthur . | |
| 3,944,768 | 3/1976 | Aryamane et al. . | |
| 4,000,383 | 12/1976 | Lockard . | |
| 4,118,611 | 10/1978 | Harris . | |
| 4,221,941 | 9/1980 | Genovese . | |
| 4,386,254 | 5/1983 | Eberhardt et al. . | |
| 4,562,318 | 12/1985 | Sorenson . | |
| 4,680,435 | 7/1987 | Sorenson . | |
| 4,697,053 | 9/1987 | Lockard . | |
| 4,777,333 | 10/1988 | Valenzona . | |

FOREIGN PATENT DOCUMENTS

| | | |
|---|---|---|
| 2368790 | 5/1978 | France . |
| 2453958A1 | 5/1976 | Germany . |
| 1914547B2 | 7/1979 | Germany . |
| 2827854A1 | 1/1980 | Germany . |
| 2005919A | 4/1979 | United Kingdom . |

*Primary Examiner*—Ernest G. Cusick
*Attorney, Agent, or Firm*—Nicholas C. Hopman

[57] ABSTRACT

A rocker switch includes at least one switch device (105) actuable by a first side (110) of a first end (106) of a spring (107). The spring (107) has a second end (108) opposing the first end (106). First (103) and opposing second (103') support members are positioned on a second side (112) at the ends (106, 108) of the spring (107). A rocker mechanism (101), which has a top portion (121), is pivotable about an axis (109). The rocker mechanism (101) is also coupled to the spring (107) proximate a center position (111). The rocker mechanism (101) is positioned in a nominal position causing contact between the second side (112) of the first end (106) of the spring (107) and the first (103) support member, and causing another contact between the second side (112) of the second end (108) of the spring (107) and the second (103') support member. This positioning centers the rocker mechanism (101). Responsive to a pivoting of the top portion (121) of the rocker mechanism (101) towards the first end (106) of the spring (107), the second side (112) of the first end (106) of the spring (107) and the first (103) support will be separated and the first end (106) of the first side (110) of the spring (107) will contact and thereby actuating the switch means (105).

15 Claims, 1 Drawing Sheet

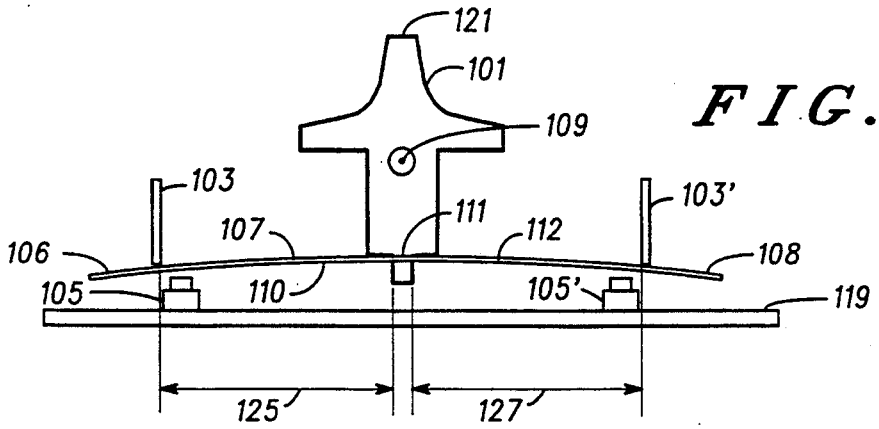
FIG. 1
FIG. 2
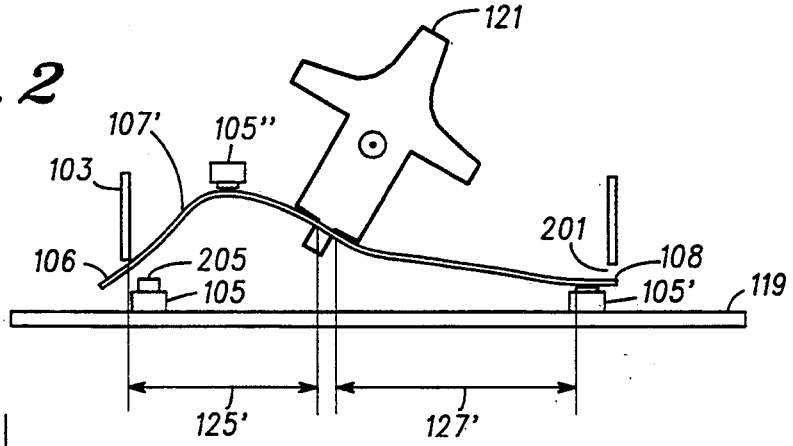
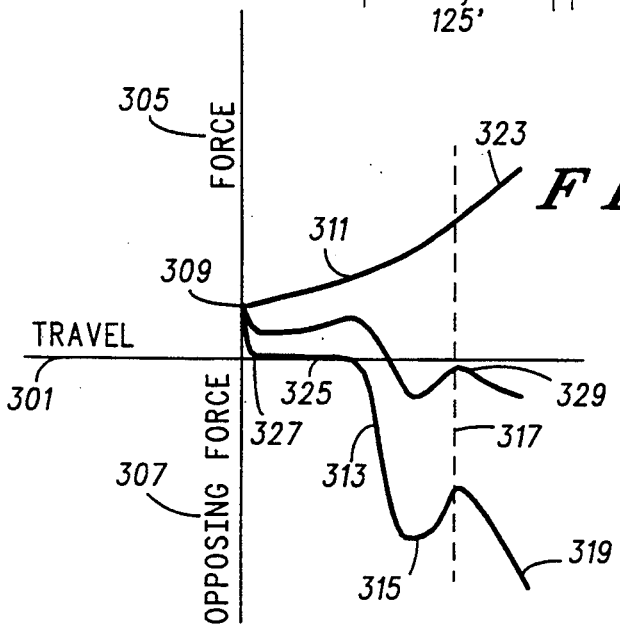
FIG. 3
FIG. 4
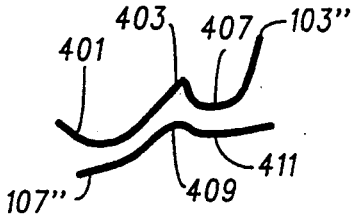
FIG. 5
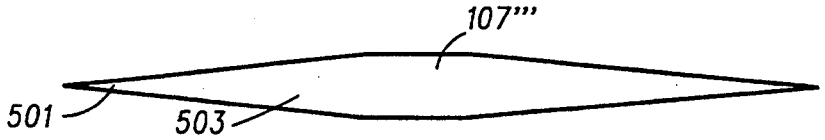

ROCKER SWITCH

Field of the Invention

This invention is generally directed to the field of electrical switches. In particular, the described device is useful for rocker switches.

BACKGROUND OF THE INVENTION

Contemporary electrical switch devices have many diverse requirements. In addition to switching electrical signals responsive to physical actuation of the switch, these may include actuation indication including tactile feedback, and/or audible feedback and/or, over-travel. Other desirable attributes include actuation aid in the form of a snap-action response, and in the case of rocker switches self-centering, and configurable force vs. travel relationships.

The need to provide such a diverse and complex set of requirements has led to many good but complex switch designs. The complexity added to meet the various requirements adversely effects switch reliability, ease of assembly, cost, and size. Also the designability of force vs. travel relationships with a complex switch design is difficult at best.

What is needed is an improved electrical switch that overcomes the problems of complexity—thus reliability, ease of assembly, cost, and size. Also, the improved electrical switch should have easy-to-design force vs. travel relationships.

BRIEF DESCRIPTION OF THE DRAWINGS

FIGS. 1 and 2 are drawings of an improved rocker switch in accordance with a preferred embodiment;

FIG. 3 is a chart illustrating force vs. travel curves associated with the rocker switch shown in FIGS. 1 and 2;

FIG. 4 is a drawing showing details of another spring member and an interfacing support member which may be alternatively applied in the rocker switch shown in FIGS. 1 and 2; and FIG. 5 is an illustration of a spring member which may be alternatively applied in the rocker switch shown in FIGS. 1 and 2.

DETAILED DESCRIPTION OF A PREFERRED EMBODIMENT

An improved rocker switch includes a singular mechanism for actuation aid, actuation indication, and self-centering of the switch's actuator. Further, the improved rocker switch has easy-to-design or easily configurable force vs. travel curve relationship. The improved switch mechanism can be more readily understood by referring to FIGS. 1 and 2.

Specifically, in FIG. 1 the improved switch mechanism includes switch means including two switch devices 105 and 105' spaced apart on a surface 119. Typically, the surface 119 may be part of a substrate used to structurally support and electrically interconnect the switches 105 and 105' to various support circuitry. The switch devices 105 and 105' may take on many configurations—a few options are discussed later. A spring member 107 includes a first end 106 of a first side 110 positioned facing one 105 of the two switches. In complement, an opposing second end 108 of the first side 110 of the spring member 107 is positioned facing another 105' of the two switches. In the embodiment presented here, the spring member is substantially longitudinal. Although this is not a strict requirement, it is preferred in the presented configuration. A first 103 and an opposing second 103' support member are positioned proximate the first end 106 and the opposing second end 108 on a second side 112, opposing the first side 110, of the spring member 107. These support members 103 and 103' are used to provide constraint to motion of the spring member away from the switches. A rocker actuating mechanism 101 is pivotable around an axis 109. The pivoting action will cause the rocker actuating mechanism 101 to move towards each of the first 106 and opposing second 108 ends of the spring member 107. The rocker actuating mechanism 101 is coupled to the spring member 107 between the first 106 and opposing second 108 ends of the spring member 107. Preferably, this coupling is proximate a center position 111 between the spring member's 107 ends 106 and 108, to ensure a balanced feel when the rocker actuating mechanism 101 is pivoted toward either end 106 and 108 of the spring member 107.

The rocker actuating mechanism 101 is positioned with respect to the support members 103 and 103', so as to cause a deflection of the spring member 107 causing the second side 112, proximate each of the first 106 and opposing second 108 ends to rest on each of the first 103 and opposing second 103' support members respectively. The axis 109 is physically defined here using a plastic feature molded as part of the rocker actuating mechanism 101. Those skilled in the art will recognize other means by which to provide an equivalent pivoting action.

The rocker switch, composed of the above-described elements, is shown here in FIG. 1 in an initial rest, or nominal position. Preferably, this occurs when the rocker actuating mechanism 10i is in its centered position. This self-centering response is maintained through a balanced relationship of forces induced in association with the spring member 107 by the prescribed relationship between the first 103 and opposing second 103' support members respectively and their influence on the rocker actuating mechanism 101. If, as in this case, the spring member 107 is constructed of a material and structure homogeneous on either side of the rocker actuating mechanism 101, then lengths of the spring member's sides, between the rocker actuating mechanism 101 and the respective support members 103 and 103', will be equal. These equidistant lengths are represented here by reference numbers 125 and 127 respectively.

Another initial rest position, for instance one that is not centered, can be easily designed by altering the forces caused on opposite sides 106 and 108 of the spring member 107. One of many techniques for achieving this is to alter the positions of 103 and 103' relative to the center of the spring member 107.

FIG. 2 shows the rocker switch in one of two actuated positions. Pivoting a top portion 121 of the rocker actuating mechanism 101 about the axis 109 in a direction favoring the opposing second 103' support member, causes the opposing second end 108 of the opposing second side 112 of the spring member 107 to deflect apart or away from the opposing second support member 103'. As the pivoting of the rocker actuating mechanism 101 continues, the first side 110 of the opposing second end 108 will come to rest in contact with one 105' of the two switches, while the first end 106 of the second side 112 of the spring member 107 maintains contact with the first support member 103. As illustrated here, the side of the spring member associated with the first end 106 is significantly distorted 107' by the pivoting action. This distortion 107' is caused by the relative positions of the support member 103 with respect to the rocker actuating mechanism 101, represented by reference number 125'. Since the spring member is flexible it conforms to the dimension 125' by distorting away from the surface 119. This deflection, or distortion of the spring member associated with the spring member's 107 first end 106 may be used to activate a switch. In particular a switch 105'' is shown here as an example. Concurrently, with me distortion of the spring member associated with the spring member's 107 first end 106, the spring member's 107 opposing second end 108 will rest on the switch 105' thereby activating it as the pivoting action continues. Note that the relative distance between the rocker actuating mechanism 101 and the support member 103' is now greater 127' than the associated distance 127 shown in FIG. 1.

If the pivoting of the rocker actuating mechanism 101 continues, then what is commonly referred to as over-travel will occur. During the over-travel, contact between the first side 110 of the opposing second end 108 and the switch 105', and contact between the first end 106 of the second side 112 of the spring member 107 and the first support member 103 will be maintained. Over-travel is desirable in certain switch applications and the amount of over-travel is easily configurable in this design.

The switches 105 and 105' used in this embodiment, may be one of many types depending on the specific requirements of the application. For instance, if a high current is being switched, the elements represented by reference numbers 105 and 105' and/or the support members 103 and 103' can be replaced by current carrying terminals, and the spring member 107 can transmit and/or break an electrical load between these members 103, 103', 105, and 105'. In addition, if the spring member 107 is configured to transmit current, electrical/electronic hardware can be embedded within the rocker actuating mechanism 101 to use or alter the current that the spring member 107 is carrying. The actuation indication afforded by this design includes an audible and tactile feedback to the operator's application of force. This feedback can be caused by different phenomena depending on the specific design of the rocker switch. For instance, the switches themselves 105 an 105' can have an indigenous snap action response. In this case audible amplification of the resulting snap-actuated response can be effected by the spring member 107.

Alternatively, passive switches may be applied for 105 and 105' and audible and tactile feedback can be caused by the dynamic performance of the spring member 107 with respect to the operator applied force. In this and the former case, the amount of amplification or attenuation of this audible and tactile feedback can be changed by altering the design of the spring member 107. For instance, different spring member 107 materials will cause different feedback performance results.

FIG. 4 shows another design approach where the audible and tactile feedback can be provided by adding a cam feature 401, 403, 407 to the support member 103, represented here by reference number 103'', and adding a corresponding detent feature 409 and 411 to the spring member 107, here shown by reference number 107''. These features 409 and 411 of the spring member 107'' would be located proximate the ends 106 an 108 respectively. So, when the pivoting of the rocker actuating mechanism 101 positioned the spring member 107'' such that the switch, either 105 or 105' was in an actuated position, the respective features of the support member 103'' and the end of the spring member 107'' would cause both audible and tactile feedback.

FIG. 3 illustrates a typical force vs. travel curve representative of the dynamic relationship between force and travel when the pivotable rocker actuating mechanism 101 is deflected in either of the above-mentioned two directions with the mechanism shown in FIGS. 1 and 2.

Referring back to FIG. 2, as the rocker actuating mechanism 101 is rotated, the force associated with the contact between the spring member 107 and the support member 103 on the side of the spring member 107 associated with the end 106, monotonically increases as shown at reference number 311 in FIG. 3. This force, shown on a force axis 305, with respect to a travel axis 301, and starts out at an initial amount 309 caused by the pre-stress associated the positioning of the rocker actuating mechanism 101 caused by the placement of the axis 109 in relationship to the support members 103 and 103' and its effect on the spring member 107. When the rocker actuating mechanism 101 is pivoted the force increases 311, and continues to increase 323 as the spring is distorted 107' as the distance 125 shortened to the distance 125'. An opposite force associated with the contact between the spring member 107 and the support member 103' on the side of the spring member 107 associated with the end 108 also starts out at the initial amplitude 309 but virtually immediately 327 drops to zero as the end 108 is deflected away from the support member 103' by the pivoting action of the rocker actuating mechanism 101. While the pivoting action continues, and the end 108 traverses the gap 201 the force associated with the spring member's 107 end 108 continues to contribute zero force as shown by reference number 325. While the pivoting action continues, and contact between the first side 110 of the opposing second end 108 of the spring member 107 and the switch 105' occurs the force continues monotonically 313 in an opposing direction as shown on the opposing force axis 307. After a certain amount of travel commencing at reference number 3 15, the spring member, due to either a snap action switch used for switch element 105' or the cam structure shown in FIG. 4, will observe a significant drop in force over a small amount of travel until reference number 319. The behavior of the spring member 107 as represented by the force vs. travel response between reference numbers 315 and 319 will provide the operator with tactile feedback as the switch 105' is actuated. Reference number 317 and the associated dashed line represent a boundary on the force vs. travel curve defining a commencement of an over-travel region as the rocker actuating mechanism 101 continues to be pivoted. After this reference point 317 the force continues to increase 319 on the spring end 108 contacting the switch 105'.

The rocker actuating mechanism 101 and thereby the rocker switch operator will actually feel a composite or net force vs. travel curve 329 which represents a summation of the just-described force vs. travel curves. Various force vs. travel curves can be easily designed to meet different design requirements based on this improved rocker switch design.

Although FIGS. 1 and 2 illustrate the essential features of the preferred embodiment, other features are also possible. For instance, another feature of this design approach is that the force vs. travel curve may be easily modifiable by introducing variable geometry springs and/or support members.

For instance, in FIG. 5, by altering the shape of the spring member 107'41 , the slope of the force vs. travel curve of FIG. 3 could be altered. In this case the spring member 107''' is configured using a geometry primarily longitudinal between the first end and the opposing second end. Also, the chosen geometry featuring a thin cross-sectional area 501 at the ends and a thicker 503 cross-sectional area near the center works as a variable rate spring. Responsive to the pivoting of the top portion 121 of the rocker actuating mechanism 101 a force vs. travel curve associated with the spring member 107''' would sharply slope between a commencement and a termination of the pivoting. Another alternative design would be to narrow and-or widen the spring at different positions in order to get a different desired force vs. travel curve.

Additionally, the presented rocker switch design is adaptable to other variations of the described design. For instance, although the rocker actuating mechanism 101 and the longitudinal spring member 107 are shown as separate components in FIG. 1, these components 101 and 107 can be easily combined into a singular component. For instance both elements 101 and 107 may be combined by injection, or insertion molding an engineered thermoplastic material that has spring-like properties.

Also, the location and number of switches and support members may be changed to acquire the optimum results. For instance, 103 could be replaced with a switch, and 105 could be replaced with a support member. A single switch utilizing a one or more support members could be used, or multiple switches on one or both ends of 107 could be used.

In conclusion, the above-described rocker switch overcomes the prior art problems of complexity. This design is simpler—thus more reliable, easier to assemble, has a lower cost, and size. Also, the improved switch has easy-to-design force vs. travel relationships. And, by having all of the actuation indication features built into a singular mechanism, the consistency, reliability, and predictability of these features are easily controlled.

What is claimed is:

1. A rocker switch comprising:

switch means;

a spring member wherein a first end of a first side of said spring member is positioned facing said switch means, said spring member having a second end opposing the first end;

first and opposing second support members positioned at the first end and the opposing second end respectively on a second side opposing the first side of said spring member; and a rocker actuating mechanism pivotable about an axis, wherein said rocker actuating mechanism is coupled a portion of said spring member proximate a center position between the first and opposing second ends, wherein the rocker actuating mechanism is positioned in a nominal position causing contact between the opposing second side of the first end of said spring member and said first support member, and causing another contact between the opposing second side of the second end of said spring member and said second support member, wherein the spring member is deflected away from said switch means, and a top portion of said rocker actuator mechanism is maintained in a position centered between the first and opposing second ends of said spring member, and wherein responsive to a pivoting of the top portion of said rocker actuating mechanism towards the first end of said spring member the opposing second side of the first end of said spring member and said first support member will be separated, and the first side of the first end of said spring member will be in contact with and thereby actuate said switch means.

2. A rocker switch in accordance with claim 1 wherein said spring member is configured using a geometry primarily longitudinal between the first end and the opposing second end.

3. A device in accordance with claim 1 wherein said spring member comprises a detent feature proximate at least one end of the first and opposing second ends on the first side, wherein said at least one of said support members comprise a cam feature, and wherein responsive to the pivoting of the top portion of said rocker actuating mechanism a force vs. travel curve associated with said spring member sharply slopes when the detent feature engages the cam feature of the corresponding support member.

4. A device in accordance with claim 1 wherein said spring member is comprised of a variable rate spring, and wherein responsive to the pivoting of the top portion of said rocker actuating mechanism a force vs. travel curve associated with said spring member sharply slopes between a commencement and a termination of the pivoting.

5. A device in accordance with claim 1 wherein responsive to a commencement of the pivoting of the top portion of said rocker actuating mechanism, a monotonically increasing force is caused between the opposing second support member, and the opposing second end of the opposing second side of said spring member, while a monotonically decreasing force is caused between the first support member and the first end of the opposing second side of said spring member.

6. A device in accordance with claim 5 wherein responsive to a continuation of the pivoting of the top portion of said rocker actuating mechanism, the monotonically increasing force is continued between the opposing second support member, and the opposing second end of the opposing second side of said spring member, and the opposing second side of the first end of said spring member and said first support member will be separated causing zero force to be applied to the first end of said spring member.

7. A device in accordance with claim 6 wherein responsive to another continuation of the pivoting of the top portion of said rocker actuating mechanism, the monotonically increasing force is continued between the opposing second support member, and the opposing second end of the opposing second side of said spring member, and the first side of the first end of said spring member will be in contact with said switch means and present a monotonically increasing force between the first side of the first end of said spring member and said switch means in a direction opposite the force caused on the opposing second end of said spring member, thereby actuating said switch means.

8. A device in accordance with claim 7 wherein responsive to further continuation of the pivoting of the top portion of said rocker actuating mechanism, the monotonically increasing force is continued between the opposing second support member, and the opposing second end of the opposing second side of said spring member, and the first side of the first end of said spring member will be in contact with said switch means and present a monotonically increasing force between the first side of the first end of said spring member and said switch means in a direction opposite the force caused on the opposing second end of said spring member, thereby providing over-travel after said switch means has been actuated.

9. A rocker switch comprising:

two switch mechanisms spaced apart;

a spring member having a first end of a first side positioned facing one of the two switch mechanisms, and an opposing second end of the first side positioned facing another of the switch mechanisms;

first and opposing second support members each positioned at the first end and the opposing second end respectively on a second side, opposing the first side, of the spring member; and a rocker actuating mechanism pivotable about an axis, wherein said rocker actuating mechanism is coupled to a portion of said spring member proximate a center position between the first and opposing second ends, wherein the rocker actuating mechanism is positioned in a nominal position causing contact between the opposing second side of the first end of said spring member and said first support member, and causing another contact between the opposing second side of the second end of said spring member and said second support member, wherein the spring member is deflected away from said two switch mechanisms, and a top portion of said rocker actuator mechanism is maintained in a position centered between the first and opposing second ends of said spring member, and wherein responsive to a pivoting of the top portion of said rocker actuating mechanism towards the first end of said spring member the opposing second side of the first end of said spring member and said first support member will be separated, and the first side of the first end of said spring member will be in contact with and thereby actuate the one of the two switch mechanisms.

10. A rocker switch in accordance with claim 9 wherein responsive to a pivoting of the top portion of said rocker actuating mechanism towards the second end of said spring member the opposing second side of the second end of said spring member and said second support member will be separated, and the first side of the second end of said spring member will be in contact with and thereby actuate the another of the two switches of said switch means.

11. A rocker switch in accordance with claim 10 wherein said spring member is configured using a geometry primarily longitudinal between the first end and the opposing second end.

12. A device in accordance with claim 9 wherein said spring member comprises a detent feature proximate at least one end of the first and opposing second ends on the first side, wherein said at least one of said support members comprise a cam feature, and wherein responsive to the pivoting of the top portion of said rocker actuating mechanism a force vs. travel curve associated with said spring member sharply slopes when the detent feature engages the cam feature of the corresponding support member.

13. A device in accordance with claim 12 wherein said spring member is comprised of a variable rate spring, and wherein responsive to the pivoting of the top portion of said rocker actuating mechanism a force vs. travel curve associated with said spring member sharply slopes between a commencement and a termination of the pivoting.

14. A device in accordance with claim 9 wherein responsive to a commencement of the pivoting of the top portion of said rocker actuating mechanism, a monotonically increasing force is caused between the opposing second support member, and the opposing second end of the opposing second side of said spring member, while a monotonically decreasing force is caused between the first support member and the first end of the opposing second side of said spring member until the opposing second side of the first end of said spring member and said first support member will be separated causing zero force to be applied to the first end of said spring member, until the first side of the first end of said spring member will be in contact with said switch means and present a monotonically increasing force between the first side of the first end of said spring member and said switch means in a direction opposite the force caused on the opposing second end of said spring member, thereby actuating said switch means.

15. A device in accordance with claim 14 wherein responsive to further continuation of the pivoting of the top portion of said rocker actuating mechanism, the monotonically increasing force is continued between the opposing second support member, and the opposing second end of the opposing second side of said spring member, and the first side of the first end of said spring member will be in contact with said switch means and present a monotonically increasing force between the first side of the first end of said spring member and said switch means in a direction opposite the force caused on the opposing second end of said spring member, thereby providing over-travel after said switch means has been actuated.

* * * * *